US009347134B2

(12) United States Patent
Morris

(10) Patent No.: US 9,347,134 B2
(45) Date of Patent: May 24, 2016

(54) CORROSION RESISTANT METALLATE COMPOSITIONS

(75) Inventor: Eric L. Morris, Irvine, CA (US)

(73) Assignee: PRC-DeSoto International, Inc., Sylmar, CA (US)

( * ) Notice: Subject to any disclaimer, the term of this patent is extended or adjusted under 35 U.S.C. 154(b) by 629 days.

(21) Appl. No.: 12/794,527

(22) Filed: Jun. 4, 2010

(65) Prior Publication Data

US 2011/0300390 A1 Dec. 8, 2011

(51) Int. Cl.

| | |
|---|---|
| ***C23C 22/34*** | (2006.01) |
| ***C23C 22/56*** | (2006.01) |
| ***C23C 22/66*** | (2006.01) |
| ***C23C 22/68*** | (2006.01) |
| ***C23C 22/83*** | (2006.01) |

(52) U.S. Cl.
CPC ..... *C23C 22/34* (2013.01); *C23C 22/68* (2013.01); *C23C 22/83* (2013.01)

(58) Field of Classification Search
CPC ..... C23C 22/34; C23C 22/361
USPC ..... 148/247
See application file for complete search history.

(56) References Cited

U.S. PATENT DOCUMENTS

| | | | | |
|---|---|---|---|---|
| 4,391,652 | A | 7/1983 | Das et al. | |
| 4,422,886 | A | 12/1983 | Das et al. | |
| 4,786,336 | A | 11/1988 | Schoener et al. | |
| 5,139,586 | A | 8/1992 | Das | |
| 5,348,640 | A | 9/1994 | Shimakura et al. | |
| 5,380,374 | A | 1/1995 | Tomlinson | |
| 5,427,632 | A | 6/1995 | Dolan | |
| 5,441,580 | A | 8/1995 | Tomlinson | |
| 5,531,820 | A | 7/1996 | Gorecki | |
| 5,582,654 | A | 12/1996 | Mansfeld et al. | |
| 5,653,823 | A | 8/1997 | McMillen et al. | |
| RE35,688 | E | 12/1997 | Gorecki | |
| 5,728,233 | A | 3/1998 | Ikeda et al. | |
| 5,855,695 | A | 1/1999 | McMillen et al. | |
| 5,868,872 | A | 2/1999 | Karmaschek et al. | |
| 5,904,784 | A | 5/1999 | Iino et al. | |
| 5,932,083 | A | 8/1999 | Stoffer et al. | |
| 5,958,511 | A | 9/1999 | Dolan | |
| 5,961,809 | A | 10/1999 | Roland et al. | |
| 5,962,145 | A | 10/1999 | Matrukawa | |
| 5,964,928 | A | 10/1999 | Tomlinson | |
| 6,022,425 | A | 2/2000 | Nelson et al. | |
| 6,027,579 | A | 2/2000 | Das et al. | |
| 6,059,896 | A | 5/2000 | Ehara et al. | |
| 6,060,122 | A | 5/2000 | Rossmaier | |
| 6,066,359 | A | 5/2000 | Yao et al. | |
| 6,068,711 | A | 5/2000 | Lu et al. | |
| 6,083,309 | A | 7/2000 | Tomlinson | |
| 6,168,868 | B1 | 1/2001 | Hauser et al. | |
| 6,206,982 | B1 | 3/2001 | Hughes et al. | |
| 6,217,674 | B1 * | 4/2001 | Gray et al. | 148/247 |
| 6,312,812 | B1 | 11/2001 | Hauser et al. | |
| 6,361,833 | B1 | 3/2002 | Nakada et al. | |
| 6,375,726 | B1 | 4/2002 | Motzdorf et al. | |
| 6,406,562 | B1 | 6/2002 | Lu et al. | |
| 6,419,731 | B2 * | 7/2002 | Inbe et al. | 106/14.44 |
| 6,423,425 | B1 | 7/2002 | Faucher et al. | |
| 6,485,580 | B1 | 11/2002 | Nakada et al. | |
| 6,503,565 | B1 | 1/2003 | Hughes et al. | |
| 6,521,029 | B1 | 2/2003 | Matzdorf et al. | |
| 6,524,403 | B1 | 2/2003 | Bartlett et al. | |
| 6,527,841 | B2 | 3/2003 | Matzdorf et al. | |
| 6,558,480 | B1 | 5/2003 | Rochfort et al. | |
| 6,663,700 | B1 | 12/2003 | Matzdorf et al. | |
| 6,679,952 | B2 | 1/2004 | Shimizu et al. | |
| 6,733,579 | B1 | 5/2004 | Gorecki | |
| 6,749,694 | B2 | 6/2004 | Greene et al. | |
| 6,753,039 | B2 | 6/2004 | Heimann et al. | |
| 6,758,916 | B1 | 7/2004 | McCormick | |
| 6,761,933 | B2 | 7/2004 | Warburton et al. | |

(Continued)

FOREIGN PATENT DOCUMENTS

| | | |
|---|---|---|
| AU | WO88/06639 | 9/1988 |
| EP | 0694593 | 1/1996 |
| EP | 0792922 | 9/1997 |
| GB | 2259920 | 3/1993 |
| WO | 9504169 | 2/1995 |
| WO | 9514117 | 5/1995 |

OTHER PUBLICATIONS

PCT International Search Report and Written Opinion, issued in International Application No. PCT/US11/39198 on Sep. 29, 2011.

Y. Zhai et al., Surface Pretreatment Based on Dilute Hexafluorozirconic Acid, Tri-Service Corrosion Conference, 2007.

*Primary Examiner* — Lois Zheng

(74) *Attorney, Agent, or Firm* — Alicia M. Passerin, Esq.

(57) ABSTRACT

A composition for application to a metal substrate comprising at least one metallate compound comprising hexafluorzirconate, zirconyl nitrate, and/or yttrium nitrate is provided. The composition may further comprise additives that promote corrosion resistance of the metal substrate, or the adhesion of subsequent coatings, such as one or more rare earth element salts; allontoin, polyvinylpyrrolidone, surfactants, and other additives and co-inhibitors. A metal substrate such as an aluminum or an aluminum alloy substrate coated with a metallate composition according to the present invention is also provided. A process for preparing a coating on a metal substrate to improve the corrosion resistance of the substrate or improve the adhesion of a subsequent coating is also provided. The process comprises treating the metal substrate with an aqueous solution comprising a metallate compound. The process may further comprise one or more pre-treating the substrate, coating the metal substrate with an oxidizing agent and/or coating the metal substrate with one or more rare earth element salts. A process for preparing the metallate coatings of the invention is also provided.

22 Claims, No Drawings

(56) References Cited

U.S. PATENT DOCUMENTS

| | | | | |
|---|---|---|---|---|
| 6,805,756 | B2 | 10/2004 | Claffey et al. | |
| 6,821,633 | B2 | 11/2004 | Liu et al. | |
| 6,869,677 | B1 | 3/2005 | Uehara et al. | |
| 6,905,775 | B1 | 6/2005 | Barlow et al. | |
| 7,452,427 | B2 | 11/2008 | Morris | |
| 2002/0117236 | A1 | 8/2002 | Matzdorf et al. | |
| 2003/0138567 | A1 | 7/2003 | Schenzle et al. | |
| 2003/0150524 | A1 | 8/2003 | Wichelhaus et al. | |
| 2003/0172998 | A1 | 9/2003 | Wojcik et al. | |
| 2003/0230215 | A1 | 12/2003 | Matzdorf et al. | |
| 2003/0230364 | A1 | 12/2003 | Greene et al. | |
| 2004/0020564 | A1 | 2/2004 | Schenzle et al. | |
| 2004/0028820 | A1 | 2/2004 | Stoffer et al. | |
| 2004/0054044 | A1 | 3/2004 | Brittner et al. | |
| 2004/0067313 | A1* | 4/2004 | Hauser | 427/304 |
| 2004/0168748 | A1 | 9/2004 | Hartwig et al. | |
| 2004/0186201 | A1 | 9/2004 | Stoffer et al. | |
| 2004/0244875 | A1 | 12/2004 | Yasuda et al. | |
| 2004/0249043 | A1 | 12/2004 | Stoffer et al. | |
| 2005/0022907 | A1 | 2/2005 | Claffey et al. | |
| 2005/0121113 | A1 | 6/2005 | Quellhorset et al. | |
| 2006/0014893 | A1 | 1/2006 | Koch et al. | |
| 2006/0151070 | A1 | 7/2006 | Rodzewich et al. | |
| 2006/0237098 | A1 | 10/2006 | Matzdorf et al. | |
| 2006/0240191 | A1 | 10/2006 | Matzdorf et al. | |
| 2007/0095435 | A1 | 5/2007 | Lammerschop et al. | |
| 2007/0095436 | A1 | 5/2007 | Matzdorf et al. | |
| 2007/0095437 | A1 | 5/2007 | Matzdorf et al. | |
| 2007/0099022 | A1 | 5/2007 | Matzdorf et al. | |
| 2007/0243397 | A1 | 10/2007 | Ludwig et al. | |
| 2008/0008902 | A1* | 1/2008 | Takakuwa et al. | 428/639 |
| 2008/0041498 | A1 | 2/2008 | Inbe et al. | |
| 2008/0081212 | A1 | 4/2008 | Inbe et al. | |
| 2008/0230395 | A1* | 9/2008 | Inbe et al. | 205/261 |
| 2009/0032144 | A1 | 2/2009 | McMillen et al. | |

* cited by examiner

CORROSION RESISTANT METALLATE COMPOSITIONS

BACKGROUND

Metals such as aluminum and their alloys have many uses in aerospace, commercial, and private industries. However, these metals have a propensity to corrode rapidly in the presence of water due to their low oxidation-reduction (redox) potential, thus significantly limiting the useful life of objects made from these metals, and/or increasing maintenance costs. These metals also have a significant problem with paint adhesion, as the surface of the metal, when formed into an object, is generally very smooth.

The oxidation and degradation of metals used in aerospace, commercial, and private industries is a serious and costly problem. To prevent the oxidation and degradation of metals, inorganic coatings are applied to the metal's surface. These inorganic, protective coatings, also referred to as conversion coatings, may be the only coating applied to the metal, or there may be an intermediate coating to which subsequent coatings are applied.

Currently, chromate based coatings are used as conversion coatings in many industrial settings because they impart corrosion resistance to the metal surface, and promote adhesion in the application of subsequent coatings. However, these chromate based conversion coatings have become unfavorable, having toxicity, environmental, and regulatory concerns. Also known are cerium and other rare earth element containing coatings have been identified as potential replacements for chromate based coatings in metal finishing. These coatings include cerium and other rare earth element containing coatings that are formed by various processes such as immersion, electroplating from a cerium nitrate solution, plating from an acidic cerium chloride containing solution and an oxidant (at elevated temperatures), as well as multistep processes, and electrolytic and non-electrolytic processes having a sealing step. Further information on such coatings can be found in: Hinton, B. R. W., et al., Materials Forum, Vol. 9, No. 3, pp. 162-173, 1986; Hinton, B. R. W., et al., ATB Metallurgie, Vol XXXVII, No. 2, 1997; U.S. Pat. Nos. 5,582,654; 5,932,083; 6,022,425; 6,206,982; 6,068,711; 6,406,562; and 6,503,565; U.S. Patent Application Publication No. US 2004/0028820 A1; and PCT Application Publication No. WO 88/06639.

However, at least some of the coatings prepared using known prior art compositions and methods do not perform as well as those formed using chromate treatments and/or can develop blisters on the surface and exhibit poor adhesion. Further, at least some of the prior art coatings can also suffer from one or more of the following disadvantages: (1) a tendency of the metal element in the conversion coating to precipitate in solution away from the base metal surface in the form of a sludge-like material; (2) difficulty in obtaining a uniform coating which does not tend to over-coat and exhibit poor adhesion to the substrate; (3) the necessity to use multiple steps and extensive periods of time to deposit a coating; (4) the use of commercially unattractive steps, such as sealing and/or the use of elevated temperature solutions; and (5) the necessity to use specific pretreatments and solution compositions in order to coat multiply alloys, especially aluminum 2024 alloys.

The ability to deposit a conversion coating composition on the surface of a high copper-containing aluminum alloy, such as aluminum 2024, which is thick enough to provide corrosion protection can be problematic. Known coating compositions often exhibit poor adhesion or require the use of multiple steps and/or elevated temperature solutions to deposit the coating composition on the alloy. Specific deoxidizers have been used to more uniformly coat the metal substrate. However, when industrially accepted cleaners and deoxidizers are used on the alloy, the surface of relatively high copper-containing aluminum alloys has a tendency to pit and corrode as the conversion coating composition is deposited on the alloy. The rate of the undesired pitting can be more extensive than the ability of the metal element in the conversion coating to deposit onto the alloy, resulting in visual pits across the alloy surface.

Therefore, there is a need for a conversion coating that can replace chromate based conversion coatings and that overcomes several of the deficiencies, disadvantages and undesired parameters of known replacements for chromate based conversion coatings. Further, there is a need for a chromate free conversion coating that imparts corrosion resistance to a metal surface and also promotes adhesion of subsequent coatings.

SUMMARY

According to the present invention, there is provided a conversion coating composition for application to a metal substrate. The conversion coating compositions according to the invention are suitable replacements for chromate based conversion coatings and the coatings of the present invention overcomes several of the deficiencies, disadvantages and undesired parameters of known replacements for chromate based conversion coatings.

According to one embodiment of the invention a composition comprising zirconyl nitrate, hexafluorozirconate or a combination thereof and a metal nitrate, preferably yttrium nitrate is provided. In another embodiment, the composition comprises zirconyl nitrate and a surfactant and/or polyvinylpyrrolidone. And, according to another embodiment, the composition comprises an aqueous carrier and yttrium nitrate. Preferably, the compositions according to the invention are substantially free (i.e., containing no more than a negligible amount) of chromates and are substantially free of Group 5 through Group 12 metals.

According to various embodiments of the invention, the coatings described herein may also contain sodium fluoride, a surfactant, and/or polyvinylpyrrolidone.

According to another embodiment, a metal substrate comprising a deoxidized or degreased aluminum or aluminum alloy substrate coated with a composition according to the present invention. The aluminum or aluminum alloy substrate may be coated in a separate step, with one or more of the following: (i) a composition consisting essentially of yttrium nitrate and an aqueous carrier; (ii) a primer coat; and/or (iii) a topcoat.

According to another embodiment, a process for coating a metal substrate is provided. According to the process, first a metal substrate is provided. Then, the metal substrate is coated with a composition according to the present invention. In an optional step, the metal substrate is coated (prior to applying the composition according to the present invention) with a composition consisting essentially of yttrium nitrate, and an aqueous carrier. In another optional step, the metal substrate may be pre-treated prior to placing the coating on the metal substrate. The pre-treating may comprise pre-cleaning the metal substrate prior to placing the coating on the metal substrate to provide a pre-cleaned metal substrate, which is followed by coating the pretreated metal substrate with a composition according to the present invention. The pre-treating may further comprise deoxidizing the pre-cleaned substrate prior to coating the pretreated metal.

DESCRIPTION

According to one embodiment of the present invention, there is provided a metallate coating for application to a metal substrate. The metallate coatings according to the invention remain sufficiently suspended in solution with little to no precipitate in storage, have improved uniformity and thickness in the coating when applied to a metal substrate; are readily deposited on the metal substrate, with an elimination of one or more prior art coating process steps; do not require an extensive period of time to deposit a coating; do not require sealing and/or the use of elevated temperature solutions. Further, the metallate coatings according to the invention promote adhesion of subsequent coatings. Accordingly, the metallate coatings according to the invention overcome several of the deficiencies, disadvantages and undesired parameters of known replacements for chromate based conversion coatings, and the metallate coatings described herein are a viable replacement for chromate based conversion coatings.

The term metal nitrate means a metal element complexed to a nitrate ($NO_3$) ion. Preferably, the metal is a Group 3 or Group 4 metal, and more preferably, the metal is a yttrium or zirconium ion or complex, most preferably, zirconyl nitrate and yttrium nitrate.

The term "metallate" means any complex anion containing a metal ligated to several atoms or small groups. Examples used in this application include hexafluorozirconate, zirconyl nitrate, and yttrium nitrate.

As used in this disclosure, the term "comprise" and variations of the term, such as "comprising" and "comprises," are not intended to exclude other additives, components, integers or steps.

As referred to herein, the term Air Products refers Air Products and Chemicals, Inc. having offices at Allentown, Pa. The term Alfa Aesar, refers to Alfa Aesar, a Johnson Matthey Company, having offices at Ward Hill, Mass. The term Deft refers to Deft Inc. having offices at Irvine, Calif. The term ProChem refers to Prochem, Inc. having offices at Rockford, Ill. The term SIG MA, refers to Sigma-Aldrich Company, having offices at St. Louis Mo.

Unless otherwise indicated, all amounts disclosed herein are given in weight percent of the total weight of the composition.

In one embodiment, the present invention is a an aqueous based metallate composition for application to a metal substrate, the composition comprising an aqueous carrier, a zirconium compound, preferably selected from the group consisting of zirconyl nitrate, hexafluorozirconate, and combinations thereof, and a metal nitrate. Preferably, the metallate composition is substantially free of chromium and chromate compounds and other Group 5 through Group 12 metals and oxidizing agents, such as $H_2O_2$.

The metallate composition may further comprises one or more of the following: sodium fluoride, preferably in an amount from about 0.05 wt % to about 0.3 wt %, wherein the sodium fluoride is provided to the composition in an aqueous solution, a surfactant (preferably in an amount from about 0.009 to about 0.9), and/or a polyvinylpyrrolidone (preferably in an amount from about 0.001 to about 0.1).

According to another embodiment of the invention, the zirconium compound comprises a hexafluorozirconate, such as $K_2ZrF_6$. Preferably, the hexafluorozirconate is present in the composition in an amount from about 0.004 to about 10 g/l, and more preferably from between about 0.04 wt % to about 0.2 wt %. According to this embodiment, the hexafluorozirconate may be combined with a metal nitrate such as yttrium nitrate ($Y(NO_3)_3$) or abbreviated "YN" as the nitrate compound in the metallate composition. Preferably, the yttrium nitrate is present in the composition in an amount of from between about 0.004 wt % to about 5 wt %, and more preferably from between about 0.01 wt % to about 5 wt %.

The yttrium nitrate is preferably a concentrate solution, such as that sold by ProChem (product no. 3858-S). Preferably, the ratio of yttrium nitrate to hexafluorozirconate is optimized such that the solution is stabilized as a suspension with little to no precipitate in storage. For example, 0.3 g to 1.3 g of $Y(NO_3)_3$ to 0.2 g of KHFZr per 250 cc of water is a preferable. It has been found that if an excess is not maintained an undesirable precipitate forms that is difficult to suspend. The composition may further comprise a surfactant, such as Dynol 604, commercially available from Air Products.

Compositions according to this embodiment include:

| Ingredient | Range (g/l) | Example 1A (g/l) | Example 1C (g/l) |
|---|---|---|---|
| $K_2ZrF_6$ | .04 to 10 | .799 | .8 |
| $Y(NO_3)_3$ | .1 to 15 | 1.331 | 1.0 |
| Surfactant | 0 to <.1 | .072 (Dynol 604) | 0 to <.1 |
| Water | remainder | 997.798 | 998.1 |

It was found that when KHFZr and yttrium nitrate (YN) solutions were mixed together, a new species was formed. This species is detectable using UV spectrophotometry and an indicator. This species is not present in either the KHFZr or YN solutions individually and it does not appear to be Zr nitrate or Y fluoride, but a reaction product thereof. The concentrations of Zr and/or Y may be tracked by the presence of the reaction product. Accordingly, the presence of Zr and Y may be monitored in the presence of other metals such as Al, Zn, F, Cd, and Fe.

According to another embodiment of the invention, the zirconium compound comprises zirconyl nitrate. Preferably, the zirconyl nitrate is present in the composition in an amount from about 0.1 g/l to about 8 g/l, and more preferably, the zirconyl nitrate is present in the composition in an amount of about 1 g/l. The zirconyl nitrate is preferably a solid, such as that sold by SIGMA. The zirconyl nitrate may be combined with a metal nitrate such as yttrium nitrate ($Y(NO_3)_3$) as the nitrate compound in the metallate composition. The yttrium nitrate is preferably a concentrate solution, such as that sold by ProChem (Product No. 3858-S). The composition may further comprise a surfactant, and optionally may contain sodium fluoride, such as that sold by Alfa Aesar.

Compositions according to this embodiment include

| Ingredient | Range (g/l) | Example 2 (g/l) |
|---|---|---|
| $ZrO(NO_3)_2$ Solid | .1 to 8 | 0.5 |
| $Y(NO_3)_3$ Soln | .3 to 13 | 1.08 |
| Surfactant | 0 to 0.9 | .0.1 (Dynol 604) |
| Water | remainder | 998.32 |

According to this embodiment of the invention, the combination of yttrium nitrate with zirconyl nitrate provides a coating that is resistant to flash corrosion rusting on Fe, and is more colorless than compositions containing hexafluorozirconate. Further, the solutions, in their preferred form do not contain peroxide, and do not contain halide. With the addition of yttrium nitrate, a thicker deposit of coating is deposited on a metal substrate in the same period of time as without yttrium nitrate on Fe. 4 g of yttrium nitrate concentrate solution appears to give a more colorless solution than the 1.3 g solution.

As detailed above, metallate coatings comprising an aqueous based metallate composition for application to a metal substrate, the composition comprising an aqueous carrier, a zirconium compound, and a metal nitrate are provided. Preferably, the metal nitrate is yttrium nitrate. The yttrium nitrate liquid concentrate is preferably present in the composition in an amount from about 0.3 g/l to about 13 g/1, and more preferably the yttrium nitrate is present in the composition in an amount of about 1 g/l.

According to another embodiment of the invention, the metallate coating comprises an aqueous carrier and zirconyl nitrate in the absence of another metallate and the composition is substantially free of Group 5 through Group 12 metals. Preferably, the amount of zirconyl nitrate in the composition is from about 0.1 g/l to about 8 g/l, and more preferably about 1 g/l. The composition may further comprise a surfactant, and/or polyvinylpyrrolidone, and/or sodium fluoride.

Another embodiment of the invention is a composition consisting essentially of an aqueous carrier, zirconyl nitrate and a surfactant. The zirconyl nitrate may be a concentrate solution, such as that sold by SIGMA, or the zirconyl nitrate may be a solid such as that sold by SIGMA. A suitable surfactant is Dynol 604, commercially available from Air Products.

Compositions according to this embodiment include:

| Ingredient | Range (g/l) | Example 3 (g/l) |
|---|---|---|
| $ZrO(NO_3)_2$ Concentrate Soln. | 1.8 to 24 | 6.000 |
| Surfactant | 0 to 1 | .072 (Dynol 604) |
| Water | remainder | 993.928 |

| Ingredient | Range (g/l) | Example 4 (g/l) |
|---|---|---|
| $ZrO(NO_3)_2$ (solid form) | 0.15 to 4 | 1.050 g |
| Surfactant | 0 to 1 | .072 (Dynol 604) |
| Water | remainder | 998.878 |

Another embodiment of the invention is a composition consisting essentially of an aqueous carrier, zirconyl nitrate a surfactant and polyvinylpyrrolidone (PVP). The zirconyl nitrate ($ZrO(NO_3)_2$ or "ZrN" may be a concentrate concentrate solution, such as that sold by SIGMA, or the zirconyl nitrate may be a solid such as that sold by SIGMA. A suitable surfactant is Dynol 604, commercially available from Air Products. Suitable polyvinylpylpyrrolidone is that sold by Alfa Aesar.

Compositions according to this embodiment include:

| Ingredient | Range (g/l) | Example 5 (g/l) |
|---|---|---|
| $ZrO(NO_3)_2$ Concentrate Soln. | 1.8 to 24 | 6.000 |
| Surfactant | 0 to 1 | .072 (Dynol 604) |
| Polyvinylpyrrolidone | 0 to 0.1 | .03 |
| Water | remainder | 993.928 |

It was found that compositions containing PVP and ZrN were able to remove pre-existing flash rust from a part/substrate during the immersion/plating process, a significant advantage over prior systems.

According to another embodiment of the invention, the composition for application to a metal substrate comprises an aqueous carrier and yttrium nitrate. Preferably, the yttrium nitrate is present in the composition in an amount from about 0.1 g/l to about 15 g/l, and preferably, the yttrium nitrate may present in the composition in an amount from about 4 g/l to about 15 g/l. The composition may consist essentially of yttrium nitrate and an aqueous carrier, and alternately a surfactant. In particular, there is an absence of other metals in the composition. In another embodiment, the composition is halide free.

Compositions according to this embodiment include

| Ingredient | Range (g/l) | Example 6A (g/l) | Example 6B (g/l) |
|---|---|---|---|
| $Y(NO_3)_3$ | .1 to 15 | 3.8 | .3 |
| Surfactant | 0 to <.1 | — | <.1 |
| Water | remainder | 996.2 | 998.8 |

According to another embodiment of the invention, a metal substrate comprising a deoxidized and/or degreased aluminum or aluminum alloy substrate coated with a composition comprising an aqueous based metallate composition for application to a metal substrate, the composition comprising an aqueous carrier, a zirconium compound, preferably selected from the group consisting of zirconyl nitrate, hexafluorozirconate, and combinations thereof, and a metal nitrate. Preferably, the metallate composition is substantially free of Group 5 through Group 12 metals and an oxidizing agent.

According to another embodiment of the invention, a deoxidized and/or degreased aluminum or aluminum alloy substrate metal substrate coated with a composition comprising an aqueous based metallate composition for application to a metal substrate, the composition comprising an aqueous carrier, a zirconium compound, preferably selected from the group consisting of zirconyl nitrate, hexafluorozirconate, and combinations thereof, and a metal nitrate. The substrate is further coated with a composition consisting essentially of yttrium nitrate and an aqueous carrier; and may optionally be coated with a primer coat, and or a topcoat.

According to another embodiment, the invention is a process for coating a metal substrate. According to this embodiment, a metal substrate is provided. Then, the metal substrate is contacted with the metallate containing conversion coating composition according to the invention, the composition comprising an aqueous carrier, a zirconium compound, preferably selected from the group consisting of zirconyl nitrate, hexafluorozirconate, and combinations thereof, and a metal nitrate. Preferably, the metallate composition is substantially free of Group 5 through Group 12 metals and an oxidizing agent.

According to one embodiment, the metal substrate may be pre-treated prior to contacting the metal substrate with the metallate conversion coating according to the present invention. The term pre-treating refers to a surface modification of the substrate that enhances the substrate for subsequent processing. Such surface modification can include one or more operations, including, but not limited to cleaning (to remove impurities and/or dirt from the surface), deoxidizing, and/or application of one or more solutions or coatings, as is known in the art. Pretreatment has many benefits, such as generation of a more uniform starting metal surface, improved adhesion of a subsequent coating to the pretreated substrate, or modification of the starting surface in such a way as to facilitate the deposition of the subsequent conversion coating.

According to another embodiment, the metal substrate may be prepared by first solvent treating the metal substrate prior to contacting the metal substrate with the metallate containing conversion coating composition. The term "solvent treating" refers to rinsing, wiping, spraying, or immersing the substrate in a solvent that assists in the removal of inks and oils that may be on the metal surface. Alternately, the metal substrate may be prepared by degreasing the metal substrate with conventional degreasing methods prior to contacting the metal substrate with the metallate containing conversion coating composition.

In a preferred embodiment, the metal substrate is pretreated by solvent treating the metal substrate. Then, the metal substrate is pre-treated by cleaning the metal substrate with an alkaline cleaner prior to application of the metallate conversion coating composition. A preferred pre-cleaner is a basic (alkaline) pretreatment cleaner. The pre-cleaner may also have also have one or more corrosion inhibitors some of which may "seed" the surface of the metal substrate during the cleaning process with the corrosion inhibitor to minimize metal surface attack, and/or facilitate the subsequent conversion coating. Other suitable pre-cleaners include degreasers and deoxidizers, such as Turco 4215-NCLT, available from Telford Industries, Kewdale, Western Australia, Amchem 7/17 deoxidizers, available from Henkel Technologies, Madison Heights, Mich., and a phosphoric acid-based deoxidizer, such as Deft product code number 88×2.

In another embodiment, the metal substrate is pre-treated by mechanically deoxidizing the metal prior to placing the metallate conversion coating composition on the metal substrate. An example of a typical mechanical deoxidizer is uniform roughening of the surface using a Scotch-Brite pad.

Additional optional steps for preparing the metal substrate include the use of a surface brightener, such as an acid pickle or light acid etch, a smut remover, as well as immersion in an alkaline solution per one of the embodiments of this disclosure.

The metal substrate may be rinsed with either tap water, or distilled/de-ionized water between each of the pretreatment steps, and may be rinsed well with distilled/de-ionized water prior to and after contact with the metallate conversion coating composition.

Once the metal substrate has been appropriately pretreated, cleaned and/or deoxidized and/or degreased, the metallate conversion coating composition is then allowed to come in contact with at least a portion of the metal's surface. The metal substrate is contacted with the metallate conversion coating composition using any conventional technique, such as dip immersion, spraying, or spread using a brush, roller, or the like. With regard to application via spraying, conventional (automatic or manual) spray techniques and equipment used for air spraying and electrostatic spraying can be used. In other embodiments, the coating can be an electrolytic-coating system or the coating can be applied in paste or gel form. The metallate conversion coating compositions may be applied in any suitable thickness, depending on the application requirements. In a preferred but not required embodiment, the final coating thickness is between about 100 to about 600 nm. During application, the metallate conversion coating composition is maintained at a temperature between about 10 degrees C. and the boiling temperature of the composition, which varies depending upon the nature of the composition. A preferred temperature range is between from between about 25 degrees C. to about 120 degrees C., and more preferably, from between about 33 degrees C. to about 118 degrees C.

When the metal substrate is coated by immersion, the immersion times may vary from a few seconds to multiple hours based upon the nature and thickness of the metallate conversion coating desired. When the metal substrate is coated using a spray application, the metallate conversion coating solution is brought into contact with at least a portion of the substrate using conventional spray application methods. The dwell time in which the metallate conversion coating solution remains in contact with the metal substrate may vary based upon the nature and thickness of conversion coating desired. Typical dwell times range from a few seconds to multiple hours. When the metal substrate is treated using a gel application, the metallate conversion coating gel is brought into contact with at least a portion of the metal substrate using either conventional spray application methods or manual swabbing. The dwell time in which the metallate conversion coating gel remains in contact with the metal substrate may vary based upon the nature and thickness of metallate conversion coating desired. Typical dwell times range from a few seconds to multiple hours. The metallate conversion coating may also be applied using other techniques known in the art, such as application via swabbing, where an appropriate media, such as cloth, is used to soak up the conversion coating solution and bring it into contact with at least a portion of a metal substrate's surface. Again, the dwell time in which the metallate conversion coating solution remains in contact with the metal substrate may vary based upon the nature and thickness of metallate conversion coating desired. Typical dwell times range from a few seconds to multiple hours. If an externally driven electrolytic application process is desired, such as electroplating, care should be given to the concentration level of halides present in the conversion coating plating bath, such as to not generate harmful species, such as chlorine gas, or other harmful by-products. After contacting the metal substrate with the metallate conversion coating, the coated metal substrate may be air dried then rinsed with tap water, or distilled/de-ionized water. Alternately, after contacting the metal substrate with the metallate conversion coating, the coated metal substrate may be rinsed with tap water, or distilled/de-ionized water, and then subsequently air dried.

According to a preferred embodiment, a method of coating a metal substrate is provided. According to this method, first, the metal substrate may be first pre-treated as described above, and then contacted (i.e., applied with any conventional technique, such as dip immersion, spraying, or spread using a brush, roller, and the like, as described above) with an intermediate conversion coating, such as a rare earth element containing conversion coating. The rare earth element containing conversion coating is preferably, for example, a conversion coating containing two different anions of the same or different rare earth element cations and an oxidizing agent. Such conversion coatings are described in United States Patent Application Publication No. 2006/0113007 A1 (Morris), incorporated herein by reference. Then, the metal substrate is contacted with the metallate conversion coating as described above, and the coated metal substrate is then be air dried and/or rinsed with tap water, or distilled/de-ionized water, in either order, as described above.

The following are tested methods of coating a metal substrate, which are provided by way of examples for this embodiment.

Example 7

Coating a Metal Substrate by Immersion Application

| Example 7 | Step 1 | Step 2 | Step 3 | Step 4 | Step 5 |
|---|---|---|---|---|---|
| Prior Art(7.1) | solvent wipe panel | immerse in deoxidizer | rinse or air dry, or air dry then rinse | — | — |
| Prior Art(7.2) | Solvent wipe panel | a. immerse in deoxidizer b. rinse | immerse in Ce coating solution* | rinse or air dry, or air dry then rinse | — |
| 7A | Solvent wipe panel | a. immerse in deoxidizer b. rinse | immerse in metallate coating solution** | rinse or air dry, or air dry then rinse | — |
| 7B | Solvent wipe panel | a. immerse in deoxidizer b. rinse | a. immerse in Ce coating solution* b. then rinse | immerse in metallate coating solution** | rinse or air dry, or air dry then rinse |
| 7C | Solvent wipe panel | immerse in deoxidizer | rinse in metallate coating solution** | rinse or air dry, or air dry then rinse | — |
| 7D | Solvent wipe panel | a. immerse in deoxidizer b. rinse | a. immerse in Ce coating solution* | rinse in metallate coating solution** | rinse or air dry, or air dry then rinse |

Example 8

Coating a Metal Substrate by Spray Application

| Example 8 | Step 1 | Step 2 | Step 3 | Step 4 |
|---|---|---|---|---|
| Prior Art (8.1) | solvent wipe panel | spray on deoxidizer | rinse or air dry, or air dry then rinse | — |
| 8A | Solvent wipe panel | a. spray on deoxidizer b. rinse | spray on metallate coating solution** | rinse or air dry, or air dry then rinse |
| 8B | Solvent wipe panel | a. spray on deoxidizer b. rinse | rinse with metallate coating solution** | rinse or air dry, or air dry then rinse |

In the above Examples 7 and 8, the term "rinse" unless otherwise qualified means to rinse with water, preferably de-ionized water. Also, the solvent wipe step may be replaced with any conventional degreasing method, including commercially available degreasers.

For all deoxidizers, Ce or metallate solutions, or rinses, the temperature range can vary from about 60 deg. to 212 degrees Farenheit, depending on the particular application, as will be understood by those of skill in the art by reference to this disclosure. A preferred application is in the absence of heat, i.e., a temperature that is above ambient (room temperature).

As shown in the above examples, the metallate coatings according to the invention may be used in replacement of a water rinse step, thus reducing costs associated with time and labor.

According to another embodiment, the present invention is a metal substrate coating system containing a deoxidizer, a metallate conversion coating composition, optionally a rare earth element conversion coating composition, and a primer coat. The metallate conversion coating compositions according to the present invention are compatible with currently used chromate-based primers and advanced performance topcoats. The primer coat can be a conventional chromate based primer coat, such as the Deft primer coat, product code 44GN072. Alternately, the primer coat can be a chromate-free primer coat, such as the coating compositions described in United States Patent Application Publication No. 2004/0249043 (Morris, et al.), and United States Patent Application Publication No. 2004/0186201 (Morris, et al.), all of which are incorporated herein by reference, and other chrome-free primers that are known in the art, and which can pass the military requirement of MIL-PRF-85582 Class N or MIL-PRF-23377 Class N may also be used with the current invention. Preferred primer coats are available from Deft, product code numbers Deft 02GN083 or Deft 02GN084.

The metal substrate coating system can additionally contain a topcoat. The term "topcoat" refers to a mixture of binder(s), which can be an organic or inorganic based polymer or a blend of polymers, typically at least one pigment, can optionally contain at least one solvent or mixture of solvents, and can optionally contain at least one curing agent. A topcoat is typically the coating layer in a single or multi-layer coating system whose outer surface is exposed to the atmosphere or environment, and its inner surface is in contact with another coating layer or polymeric substrate. Examples of suitable topcoats include those conforming to MIL-PRF-85285D, such as Deft product code numbers Deft 03W127A and Deft 03GY292. A preferred topcoats is an advanced performance topcoat, such as Deft product code numbers Defthane® ELT™99GY001 and 99WO09. However, other topcoats and advanced performance topcoats can be used in the coating system according to the present invention as will be understood by those of skill in the art with reference to this disclosure.

In an alternate embodiment, the present invention is a metal substrate coating system containing a conversion coating according to the present invention and a self-priming topcoat, or an enhanced self-priming topcoat. The term "self-priming topcoat", also referred to as a "direct to substrate" or "direct to metal" coating, refers to a mixture of a binder(s), which can be an organic or inorganic based polymer or blend of polymers, typically at least one pigment, can optionally contain at least one solvent or mixture of solvents, and can optionally contain at least one curing agent. The term "enhanced self-priming topcoat", also referred to as an "enhanced direct to substrate coating" refers to a mixture of functionalized fluorinated binders, such as a fluoroethylene-alkyl vinyl ether in whole or in part with other binder(s), which can be an organic or inorganic based polymer or blend of polymers, typically at least one pigment, can optionally contain at least one solvent or mixture of solvents, and can optionally contain at least one curing agent. Examples of self-priming topcoats include those that conform to TT-P-2756A. Preferred self-priming topcoats are Deft product code numbers 03W169 and 03GY369. Examples of enhanced self-priming topcoats include Defthane® ELT™/ESPT, available from Deft. An example of a preferred self-priming topcoat is Deft product code number 97GY121. However, other self-priming topcoats and enhanced self-priming topcoats can be used in the coating system according to the present invention as will be understood by those of skill in the art with reference to this disclosure.

The self-priming topcoat and enhanced self-priming topcoat is typically applied directly to the conversion coated substrate. The self-priming topcoat and enhanced self-priming topcoat can optionally be applied to an organic or inorganic polymeric coating, such as a primer or paint film. The self-priming topcoat layer and enhanced self-priming topcoat is typically the coating layer in a single or multi-layer coating system where the outer surface of the coating is exposed to the atmosphere or environment, and the inner surface of the coating is typically in contact with the conversion coated substrate or optional polymer coating or primer.

The topcoat, self-priming topcoat, and enhanced self-priming topcoat can be applied to the conversion coated substrate, in either a wet or "not fully cured" condition that dries or cures over time, that is, solvent evaporates and/or there is a chemical reaction. The coatings can dry or cure either naturally or by accelerated means for example, an ultraviolet light cured system to form a film or "cured" paint. The coatings can also be applied in a semi or fully cured state, such as an adhesive.

According to another embodiment, a process for preparing a metallate conversion coating solution is provided. According to this embodiment, first, a yttrium salt, such as $Y(NO_3)_3$, in a solution is provided. Next, a zirconium salt, such as zirconyl nitrate or hexafluorozirconate, in a solution is provided. The zirconium and yttrium salts may be dissolved in water as part of the process, or purchased in a prepared solution. Next, the yttrium and zirconium salts are combined with an excess of yttrium. A 0.85 to 0.9 g of yttrium salt to 0.8 g of zirconium salt is preferred. It has been observed that using less yttrium causes a precipitate to form that is difficult to suspend.

According to another embodiment, a process for preparing a metallate conversion coating solution is provided. According to this embodiment, first, a yttrium salt, such as $Y(NO_3)_3$, in a solution is provided. Next, a zirconium salt, such as zirconyl nitrate or hexafluorozirconate, in a solution is provided. The zirconium and yttrium salts may be dissolved in water as part of the process, or purchased in a prepared solution. Next, the yttrium and zirconium salts are combined with an excess of zirconium. Any precipitate that forms is filtered and removed from the solution.

In a preferred embodiment, first hexafluorozirconate is dissolved in warm water and then allowed to cool to room temperature. Next, yttrium nitrate is dissolved in room temperature water. The yttrium nitrate solution is then added to the hexafluorozirconate solution with high agitation and stirred for 30 minutes. A surfactant is then added under high agitation and stirred for 30 minutes. The solution will be milky (i.e., cloudy) with little or no settling. Any settling that is observed can be reagitated into a suspension. This formulation has been found to be more stable over time than solutions containing only hexafluorozirconate.

The invention will be further described by reference to the following non-limiting examples, which are offered to further illustrate various embodiments of the present invention. It should be understood, however, that many variations and modifications be made while remaining within the scope of the present invention.

EXAMPLES

The following example demonstrates the general procedures for preparation of metallate coating compositions and application of the coating compositions to the metal substrate. However, other formulations and modifications to the following procedures can be used according to the present invention as will be understood by those of skill in the art with reference to this disclosure.

A. Coating Composition Preparation:

The metallate coating composition was prepared with the amounts of ingredients shown in Tables 1-5 for each panel.

B. Metal Substrate (Panel) Preparation:

For the results provided in Tables 1 and 2, the metal substrate was bare A1 2024-T3. In Table 1 the panels were treated using a spray application process. In Table 2, the panels were treated using an immersion process. In Tables 1 and 2, the bare 2024-T3 aluminum alloy panels were first treated with scotch brite, as indicated, and then deoxidized and/or degreased for three minutes using Deft product code X7 Series Deoxidizer, a deoxidizer/degreaser having a pH greater than 8. The panels were then rinsed well with deionized water prior to contact with the conversion coating solution.

For the results provided in Table 3, the metal substrates were A1 5052-H32, cold roll steel (CRS), electro-zinc galvanized (EZG) steel and hot dip galvanized (HDG) steel. The substrates were treated via the coating processes provided below.

For the results shown in Tables 4 and 5, the metal substrate was cold roll steel (CRS). The substrates were treated via the coating processes provided below.

Immersion Processes for Ferrous and Non-Ferrous Substrates.

| Stage | Process I | Process II |
|---|---|---|
| 1 | Spray Alkaline Pre-Clean | Immersion Alkaline Cleaner |
| 2 | Immers Alkaline Clean | Immersion Rinse |
| 3 | Spray Rinse (Indust. Water) | Immersion Zr—Y Based solution |
| 4 | Immers Rinse (Indust. Water) | Immersion Rinse |
| 5 | Immers RECC 3016 Act. (indst.) | |
| 6 | Immers RECC 2012 (RO Water) | |
| 7 | Immers Rinse (Indust. Water) | |
| 8 | Immers Dilute RECC 2012 Seal (RO) | |
| 9 | Immers Dilute RECC 2012 Seal (RO) | |
| 10 | Immers Rinse (Recyc RO) | |
| 11 | Immers Rinse (Virgin RO) | |

C. Application Procedure:

For the results provided in Tables 1 and 2, the metallate coating solution was applied to the metal substrate using either a spray process or a dip/immersion process, as indicated. After application of the conversion coating, the coated substrate was rinsed well with de-ionized water.

For the results provided in Table 3, the metallate coating solution was applied to the metal substrate using an immersion process. After application of the conversion coating, the coated substrate was rinsed well with de-ionized water.

D. Testing Procedure:

For the results provided in Tables 1 and 2, the tests were run on various sample formulations, according to ASTM B117 procedure, for a 2-day salt spray test and the results evaluated according to the Rating Scale I, provided below.

For the results provided in Table 3, the tests were performed according to ASTM B117 procedure, for 500 hours and 1000 hours salt spray exposure, and the results were evaluated according to ASTM D1654 and ASTM D610, and rated according to the Rating Scales IIA and IIB, provided below.

Rating Scale I. Corrosion Rating Scale For Unpainted Surfaces Exposed to ASTM Neutral Salt Spray.

| Corrosion Activity | Rating Number |
|---|---|
| No Corrosion Activity | 10 |
| Less than or equal to five pits with corrosion salt tails per 3" × 6" panel | 9 |
| Less than or equal to fifteen pits with corrosion salt tails | 8 |
| >15 pits with corrosion salt tails/≤0.1% of surface area pitted with corrosion salt tails | 7 |
| >0.1% of surface pitted with corrosion salt tails/≤1% of surface area pitted with tails | 6 |
| >1% of surface pitted with corrosion salt tails/≤3% of surface area pitted with tails | 5 |
| >3% of surface pitted with corrosion salt tails/≤10% of surface area pitted with tails | 4 |
| >10% of surface pitted with corrosion salt tails/≤16% of surface area pitted with tails | 3 |
| >16% of surface pitted with corrosion salt tails/≤33% of surface area pitted with tails | 2 |

-continued

| Corrosion Activity | Rating Number |
|---|---|
| >33% of surface pitted with corrosion salt tails/≤50% of surface area pitted with tails | 1 |
| >50% of surface pitted with corrosion salt tails | 0 |

Rating Scale IIA. Rating of Failure at Scribe (Procedure A)

| Representative Mean Creepage From Scribe | | |
|---|---|---|
| Millimeters | Inches (Approximate) | Rating Number |
| Zero | 0 | 10 |
| Over 0 to 0.5 | 0 to 1/64 | 9 |
| Over 0.5 to 1.0 | 1/64 to 1/32 | 8 |
| Over 1.0 to 2.0 | 1/32 to 1/16 | 7 |
| Over 2.0 to 3.0 | 1/16 to 1/8 | 6 |
| Over 3.0 to 5.0 | 1/8 to 3/16 | 5 |
| Over 5.0 to 7.0 | 3/16 to 1/4 | 4 |
| Over 7.0 to 10.0 | 1/4 to 3/8 | 3 |
| Over 10.0 to 13.0 | 3/8 to 1/2 | 2 |
| Over 13.0 to 16.0 | 1/2 to 5/8 | 1 |
| Over 16.0 to more | 5/8 to more | 0 |

Rating Scale IIB. Rating of Unscribed Areas (Procedure B)

| Area Failed % | Rating Number |
|---|---|
| No failure | 10 |
| 0 to 1 | 9 |
| 2 to 3 | 8 |
| 4 to 6 | 7 |
| 7 to 10 | 6 |
| 11 to 20 | 5 |
| 21 to 30 | 4 |
| 31 to 40 | 3 |
| 41 to 55 | 2 |
| 56 to 75 | 1 |
| Over 75 | 0 |

E. Results.

Various concentration ranges of hexafluorozirconate compositions were tested on bare aluminum panels with and without panel preparation with scotch brite (Sct-Brte) abrasion, as shown in Table 1 and Table 2 below.

TABLE 1

Bare 2024-T3 Aluminum Alloy Panel Evaluation.

| Panel No. | Sct-Brte | Application I Spray | Time I | Application II | Time II | 2-Day S.S.* |
|---|---|---|---|---|---|---|
| 1 | Y | X7 Series Deox | 3 m | 0.05 g/250 - KHFZr | 1 m | 5 |
| 2 | Y | X7 Series Deox | 3 m | 0.05 g/250 - KHFZr | 5 m | 4 |
| 3 | Y | X7 Series Deox | 3 m | 0.1 g/250 - KHFZr | 1 m | 7 |
| 4 | Y | X7 Series Deox | 3 m | 0.1 g/250 - KHFZr | 5 m | 4 |
| 5 | Y | X7 Series Deox | 3 m | 0.3 g/250 - KHFZr | 1 m | 8 |
| 6 | Y | X7 Series Deox | 3 m | 0.3 g/250 - KHFZr | 5 m | 6 |
| 7 | Y | X7 Series Deox | 3 m | 0.6 g/250 - KHFZr | 1 m | 7 |
| 8 | Y | X7 Series Deox | 3 m | 0.6 g/250 - KHFZr | 5 m | 5 |
| 9 | Y | X7 Series Deox | 3 m | 1.0 g/250 - KHFZr | 1 m | 7 |
| 10 | Y | X7 Series Deox | 3 m | 1.0 g/250 - KHFZr | 5 m | 4 |

*Rating Scale I

TABLE 2

Bare 2024-T3 Aluminum Alloy Panel Evaluation.

| Panel No. | Application I (Immersion) | Time I | Application II | Time II | 2-Day S.S.* |
|---|---|---|---|---|---|
| 1 | X7 Series Deox | 3 m | 0.05 g/250 - KHFZr | 1 m | 3 |
| 2 | X7 Series Deox | 3 m | 0.05 g/250 - KHFZr | 5 m | 4 |
| 3 | X7 Series Deox | 3 m | 0.1 g/250 - KHFZr | 1 m | 3 |
| 4 | X7 Series Deox | 3 m | 0.1 g/250 - KHFZr | 5 m | 5 |
| 5 | X7 Series Deox | 3 m | 0.3 g/250 - KHFZr | 1 m | 4 |
| 6 | X7 Series Deox | 3 m | 0.3 g/250 - KHFZr | 5 m | 5 |
| 7 | X7 Series Deox | 3 m | 0.6 g/250 - KHFZr | 1 m | 3 |
| 8 | X7 Series Deox | 3 m | 0.6 g/250 - KHFZr | 5 m | 4 |
| 9 | X7 Series Deox | 3 m | 1.0 g/250 - KHFZr | 1 m | 3 |
| 10 | X7 Series Deox | 3 m | 1.0 g/250 - KHFZr | 5 m | 3 |

*Rating Scale I

As shown in Tables 1 and 2, aluminum alloy panels were coated by (spray) Table 1, and immersion (Table 2) with various concentrations of potassium hexafluorozirconate and tested according to ASTM B117 procedure, for a 2-day salt spray test. For both the immersion and spray applied treatments, the concentration that provided the best performance after salt spray exposure was 0.3 g potassium hexafluorozirconate per 250 g de-ionized water. Although other ranges of concentrations of the hexafluorozirconate solution provided no more than 11% failure (Table 1) for the spray application and no more than 21% failure (Table 2) for the immersion application.

For the results shown in Table 3 below, the substrate indicated in the table was coated by immersion using the composition according to Example 1 herein, containing potassium hexafluorozirconate and yttrium nitrate.

As shown in Table 3, in the 500 hr and 1000 hr salt spray test of the various ferrous and non-ferrous panels coated with the Zr/Y solution, there was no more than 1% failure for all unscribed panels, and no more than 3 mm of creepage was observed in the scribed area for the EZG substrate, with better results obtained for the other substrates, including no more than 0.5 mm of creepage for the aluminum substrate. Thus, the Zr/Y solution may be used with good to excellent results on various types of metal substrates.

TABLE 3

Zr/Y Conversion Coated Ferrous and Non-Ferrous Subtrates Evaluation.

| Formula | Primer | Substrate | Evaluation | Results* |
|---|---|---|---|---|
| Zr/Y Solution | E-Coat | CRS | 500 Hrs N.S.S. | 8A, 9B |
| Zr/Y Solution | E-Coat | CRS | 500 Hrs N.S.S. | 8A, 9B |
| Zr/Y Solution | E-Coat | CRS | 500 Hrs N.S.S. | 7A, 9B |
| Zr/Y Solution | E-Coat | CRS | 500 Hrs N.S.S. | 8A, 9B |
| Zr/Y Solution | E-Coat | HDG | 500 Hrs N.S.S. | 7A, 9B |
| Zr/Y Solution | E-Coat | EZG | 500 Hrs N.S.S. | 6A, 9B |
| Zr/Y Solution | E-Coat | CRS | 1000 Hrs N.S.S. | 7A, 9B |
| Zr/Y Solution | E-Coat | CRS | 1000 Hrs N.S.S. | 7A, 9B |
| Zr/Y Solution | E-Coat | CRS | 1000 Hrs N.S.S. | 7A, 9B |
| Zr/Y Solution | E-Coat | EZG | 1000 Hrs N.S.S. | 7A, 9B |
| Zr/Y Solution | E-Coat | Al 5052 | 1000 Hrs N.S.S. | 9A, 10B |
| Zr/Y Solution | E-Coat | Al 5052 | 1000 Hrs N.S.S. | 9A, 10B |

*Rating Scale IIA and IIB

F. Flash Corrosion Data

For the flash corrosion experiments, cold roll steel panels (CRS) were immersed in the coating solution shown in Tables 4 and 5 for 2 minutes, followed by hanging on a rack for 1 minute to simulate moving from one bath to another. Then, the panel was rinsed in city tap water for 30 seconds, let semi dry for 1 minute, rinsed again with city tap water for 30 seconds, let semi dry for 1 minute, rinsed with city water for 30 seconds and let dry 1 minute, rinsed with deionized water for 30 seconds, then let fully dry. This was repeated four times in order imitate a flash-rusting environment. The results are shown in Tables 4 and 5. Panels were ranked based on ASTM D610, as shown in Rating Scale III below. Any activity at the very edge or bottom of the panels where panels sat in trays was not counted.

Rating Scale III. Scale and Description of Rust Ratings.

| Rust Grade | Percent of Surface Rusted | Visual Examples Spot(s) | General (G) | Pin-point (P) |
|---|---|---|---|---|
| 10 | ≤0.01% | | | |
| 9 | >0.01% and up to 0.03% | 9 | 9 | 9 |
| 8 | >0.03% and up to 0.1% | 8 | 8 | 8 |
| 7 | >0.1% and up to 0.3% | 7 | 7 | 7 |
| 6 | >0.3% and up to 1.0% | 6 | 6 | 6 |
| 5 | >1.0% and up to 3.0% | 5 | 5 | 5 |
| 4 | >3.0% and up to 10.0% | 4 | 4 | 4 |
| 3 | >10.0% and up to 16.0% | 3 | 3 | 3 |
| 2 | >16.0% and up to 33.0% | 2 | 2 | 2 |
| 1 | >33.0% and up to 50.0% | 1 | 1 | 1 |
| 0 | >50% | None | None | None |

For Table 4 and Table 5 below:

YN means yttrium nitrate concentrate

ZrNO3 means zirconyl nitrate concentrate

CeCN means cerium nitrate concentrate

CeCl means cerium chloride concentrate

NaF is sodium fluoride

All formulas contained about 1 drop surfactant per 240 cc's solution used.

240 cc means each beaker had a final volume of 240 cc's using deionized water

TABLE 4

Cold Roll Steel Panel Evaluation.

| Panel Number | Solution Description | Results* |
|---|---|---|
| 1 | 1.5 g ZrNO3 + 1 g YN + 10 g (0.3% NaF)/240 cc's | 6P |
| 2 | 1.5 g ZrNO3 + 1 g YN + 10 g (0.3% NaF)/240 cc's | 6P |
| 3 | 1.5 g ZrNO3 + 1 g YN + 10 g (0.3% NaF)/240 cc's | 9P |
| 4 | 1.5 g ZrNO3 + 1 g YN/240 cc's | 9P |
| 5 | 1.5 g ZrNO3 + 25 g (0.3% NaF)/240 cc's | 1P |
| 6 | 1.5 g ZrNO3/240 cc's | 3P |
| 7 | 3 g ZrNO3/240 cc's | 5P |
| 8 | 5 g ZrNO3/240 cc's | 6P |
| 9 | 1.5 g ZrNO3 + 1 g YN + 5 g (0.3% NaF)/240 cc's | 9P |
| 10 | 1.6 g ZrNO3 + 0.3 g YN + 35 g (0.3% NaF)/240 cc's | 7P |
| 11 | 1.6 g ZrNO3 + 0.3 g YN + 10 g (0.3% NaF)/240 cc's | 9P+ |
| 12 | 1.5 g ZrNO3 + 0.3 g YN/240 cc's | 9P+ |
| 13 | 1.5 g ZrNO3 + 0.008 g Polyvinylpyrrolidone/240 cc's | 9P+ |

*Rating Scale III

TABLE 5

Cold Roll Steel Panel Evaluation.

| Panel Number | Solution Description | Results* |
|---|---|---|
| 1 | $H_2O$ Only - No Inhibitor in Solution | 4P 4G |
| 2 | 0.6 g KHFZr + 0.75 g YN/750 cc DI water | 9P+ |
| 3 | 0.6 g KHFZr + 0.045 g YN/750 cc DI water | 7G |

TABLE 5-continued

Cold Roll Steel Panel Evaluation.

| Panel Number | Solution Description | Results* |
|---|---|---|
| 4 | 0.6 g KHFZr + 2 g YN/750 cc DI water | 9G |
| 5 | 0.3 g KHFZr/250 cc's DI water | 7P/8P |
| 6 | 37.35 g CeN + 0.13 g NaF + 31 drops $H_2O_2$ 30 wt %/800 cc DI water (Fresh/no induction time) | 3P |
| 7 | 37.35 g CeN + 0.13 g NaF + 31 drops $H_2O_2$ 30 wt %/800 cc DI water (with induction time) | 9P |
| 8 | 7.6 g CeCl + 16 g CeN + 0.9 g NaF + 26 drops $H_2O_2$ 30 wt %/ 750 cc's DI water | 6P |
| 9 | 3 g ZrNO3/500 g DI water | 8G/8P |

*Rating Scale III

As shown in Tables 4 and 5, formulations containing Zr, and optionally, in combination with one or more of Y, polyvinylpyrrolidone, and a halide have the ability to minimize the formation of flash rust on CRS panels. These results were comparable or exceeded the results when compared to compositions containing various compositions containing Ce, Nitrate, and Fluoride ions, and an oxidizing agent ($H_2O_2$), as shown in Table 5, Panels 6, 7 and 8.

Although the present invention has been discussed in considerable detail with reference to certain preferred embodiments, other embodiments are possible. Therefore, the scope of the appended claims should not be limited to the description of preferred embodiments contained herein.

What is claimed is:

1. A composition for application to a metal substrate, the composition comprising:

an aqueous carrier;

hexafluorozirconate; and yttrium nitrate, wherein the yttrium nitrate is present in a sufficient amount so that the composition is stabilized as a suspension with no precipitate, the amount of the yttrium nitrate in the composition is greater than an amount of the hexafluorozirconate in the composition, and the composition is substantially free of Group 5 through Group 12 metals.

2. The composition according to claim 1, further comprising sodium fluoride, wherein the sodium fluoride is provided to the composition in an aqueous solution.

3. The composition according to claim 1, further comprising a surfactant.

4. The composition according to claim 1, further comprising polyvinylpyrrolidone.

5. The composition according to claim 1, wherein the hexafluorozirconate is present in the composition in an amount from 0.004 to 10 g/l.

6. The composition according to claim 1, wherein the yttrium nitrate is present in the composition in an amount from 0.1 to 15 g/l.

7. The composition according to claim 6, wherein the yttrium nitrate is present in the composition in an amount of 1 g/l.

8. The composition according to claim 1, wherein the hexafluorozirconate comprises potassium hexafluorozirconate.

9. The composition for application to a metal substrate according to claim 1 wherein:

the hexafluorozirconate is present in an amount of from 0.004 wt % to 5 wt %; and the yttrium nitrate is present in an amount of from 0.004 wt % to 5 wt %; and the aqueous carrier comprises water.

10. The composition for application to a metal substrate according to claim 9, wherein the yttrium nitrate is present in the composition in an amount of from 0.1 wt % to 2 wt %.

11. The composition for application to a metal substrate according to claim 9, the composition further comprising:

sodium fluoride in an amount from 0.05 wt % to 0.3 wt %.

12. The composition of claim 1, wherein the weight ratio of yttrium nitrate to hexafluorozirconate is between 1.5:1 and 7:1.

13. A composition for application to a metal substrate, the composition consisting of:

an aqueous carrier;

hexafluorozirconate; and yttrium nitrate, wherein the yttrium nitrate is present in a sufficient amount so that the composition is stabilized as a suspension, and the amount of the yttrium nitrate in the composition is greater than an amount of the hexafluorozirconate in the composition.

14. A metal substrate comprising a deoxidized or degreased aluminum or aluminum alloy substrate coated with:

(i) a composition according to claim 1.

15. The metal substrate according to claim 14, further comprising:

(ii) a coating comprising a composition consisting essentially of yttrium nitrate and an aqueous carrier.

16. The metal substrate according to claim 14, further comprising a primer coat.

17. The metal substrate according to claim 14, further comprising a topcoat.

18. A process for coating a metal substrate, comprising:

coating the metal substrate with a first composition, the first composition comprising the composition according to claim 1.

19. The process according to claim 18, further comprising pre-treating the metal substrate prior to coating the metal substrate with the first composition.

20. The process according to claim 19, wherein the pre-treating comprises pre-cleaning the metal substrate prior to coating the metal substrate with the first composition to provide a pre-cleaned metal substrate.

21. The process according to claim 20, wherein the pre-treating further comprises deoxidizing the pre-cleaned substrate prior to coating the metal substrate with the first composition.

22. The process according to claim 18, further comprising prior to coating the metal substrate with the first composition, coating the metal substrate with a composition consisting essentially of yttrium nitrate, and an aqueous carrier.

* * * * *